United States Patent [19]

Mouton

[11] Patent Number: 4,531,451

[45] Date of Patent: Jul. 30, 1985

[54] MULTIPLE CHAMBER COAXIAL HYDRAULIC JACK AND CONTROL SYSTEM THEREFOR

[75] Inventor: Pierre C. Mouton, Grigny, France

[73] Assignee: Société Nationale d'Etude et de Construction de Moteurs d'Aviation "S.N.E.C.M.A.", Paris, France

[21] Appl. No.: 536,433

[22] Filed: Sep. 27, 1983

[30] Foreign Application Priority Data

Sep. 28, 1982 [FR] France ..... 82 16263

[51] Int. Cl.[3] ..... F15B 11/22

[52] U.S. Cl. ..... 92/108; 92/110; 92/112; 91/519; 91/520

[58] Field of Search ..... 92/108, 107, 110, 112; 91/519, 520

[56] References Cited

U.S. PATENT DOCUMENTS

| | | | |
|---|---|---|---|
| 524,184 | 8/1894 | Palmer | 92/107 |
| 2,511,883 | 6/1950 | Thierry . | |
| 3,335,642 | 8/1967 | Rosaen | 92/111 |
| 3,792,643 | 2/1974 | Scheafer | 91/519 |
| 3,877,349 | 4/1975 | Schindel | 92/108 |
| 4,380,427 | 4/1983 | Hehl | 91/519 |
| 4,409,884 | 10/1983 | Buehringer | 92/108 |

FOREIGN PATENT DOCUMENTS

| | | | |
|---|---|---|---|
| 86340 | 8/1894 | Fed. Rep. of Germany | 92/107 |
| 1157486 | 11/1963 | Fed. Rep. of Germany . | |
| 1965612 | 11/1970 | Fed. Rep. of Germany . | |
| 2257450 | 6/1973 | Fed. Rep. of Germany | 92/108 |
| 2220180 | 11/1973 | Fed. Rep. of Germany . | |
| 2814513 | 10/1978 | Fed. Rep. of Germany | 92/110 |
| 8440 | 6/1888 | United Kingdom | 91/519 |

OTHER PUBLICATIONS

U.S. Patent & Trademark Office Classification Definitions, Cl 91, Motors, 2/1975, pp. 91–92, (1).

*Primary Examiner*—Robert E. Garrett
*Assistant Examiner*—Richard S. Meyer
*Attorney, Agent, or Firm*—Bacon & Thomas

[57] ABSTRACT

An hydraulic jack having more than two chambers is disclosed and is intended for use in a system of jacks, the displacement of which is to be synchronized. Each jack has a cylindrical center cavity in which a piston with a cylindrical cross section reciprocates, an annular cavity in which a piston with an annular cross-section reciprocates, and a rod for transmitting thrust connected to both pistons. In order to provide the jack with a minimum longitudinal dimension and with maximum rigidity, the two cavities are concentric and are separated by a stationary intermediate wall. The two pistons are connected to the rod for the transmission of thrust.

4 Claims, 7 Drawing Figures

MULTIPLE CHAMBER COAXIAL HYDRAULIC JACK AND CONTROL SYSTEM THEREFOR

BACKGROUND OF THE INVENTION

1. Field of the Invention

The invention concerns hydraulic jacks containing more than two cylinders. In jacks of this type which contain, for example, two cylinders, one cylinder may be designated the "working cylinder" since it encloses a piston intended to apply a displacing force to a mobile structure, and the other may be designated a "master cylinder" since it encloses a piston that is connected mechanically or hydraulically with the piston of the "working cylinder". Jacks of this type are used in particular in a hydraulic circuit to impose synchronous strokes on all of the pistons of the "working cylinders". In fact, synchronization is necessary in all assemblies of mobile structures, wherein mutual connections have weak or zero rigidity and the hydraulic synchronization of the control cylinders makes it possible to avoid the complexities of a mechanical synchronizing system.

2. Brief Description of the Prior Art

Systems of multiple chamber hydraulic cylinders are already known, as shown in French Patent No. 2,433,661. They are primarily used to actuate the thrust reversers of turbojet engines. In order to provide these systems with minimum space requirements and maximum rigidity, each jack has double cylinders and is of the type comprising: a "working cylinder" in which a first piston is slidably retained, with a hollow cylindrical piston rod attached thereto and connected with the mobile structure to be controlled; and, a "master cylinder" formed inside the hollow piston rod and containing a second piston fixedly placed between two rigid conduits, one of which passes through a first chamber of the "master cylinder", the first piston and a first chamber of the "working cylinder", and the other passes through the second chamber of the "master cylinder" and the second annular chamber of the "working cylinder" surrounding the "master cylinder", which moves in said chamber simultaneously with the first piston separating the two chambers of the "working cylinder".

Each chamber of the "master cylinder" communicates through a passage in the second piston with the conduit attached to its opposing face. By these arrangements, the differential thrust applied to the second piston under the effect of the hydraulic pressures prevailing respectively in the two chambers which are separated by the second piston is transmitted to the first piston connected with the rod of the jack.

It will be seen hereinafter in the course of the present description, why this configuration of the prior art has certain disadvantages, notably the fragility of certain elements, a large longitudinal dimension, and the necessary complexity of the connections to be established between the rod of the jack and the structure to be moved.

SUMMARY OF THE INVENTION

A first object of the invention is to provide a jack of the aforementioned type containing more than two chambers and one which is free of the aforesaid difficulties. The jack according to the invention has the further advantage of requiring only three hydraulic line connections for the circulation of the liquid to control the jack, in place of the four in the configuration of the prior art. This permits the use in a system of synchronized jacks an assembly of conduits requiring less space, together with a simpler installation.

The hydraulic jack according to the invention is characterized in that: the body of the cylinder contains on the inside a stationary annular median wall between a central cavity and an annular peripheral cavity; a mobile center piston in the central cavity which separates the latter into first and second chambers; an annular piston slidable in the annular peripheral cavity which separates it into third and fourth annular chambers; both pistons are rigidly connected to a piston rod of the jack which, in turn, is connected with the unit to be controlled; the annular median wall is traversed by at least one orifice connecting the second chamber of the central cavity with the fourth chamber of the annular cavity, both chambers being located on the rod side of the pistons; and, the cross section of the annular chamber on one side of the piston is equal to the sum of the cross sections of the two chambers located on the rod side of the piston.

Advantageously, to increase the thrust of the jack: the piston rod contains a central rod portion connected to the central piston and an annular rod portion surrounding and spaced from the annular median wall connected to the annular piston; both of the rod portions emerge from a first end of the jack through fluid tight passages and are interconnected at their distal ends to form a fifth chamber communicating, through a channel provided in the length of the central rod and in the central piston, with the first chamber located on the side of the central piston opposing the central rod; and, the rod with the annular cross section is further traversed in the vicinity of the annular piston by at least one orifice which connects the two annular portions of the fourth chamber separated by the annular rod portion.

A further object of the invention is to provide a system of synchronized jacks containing at least two jacks according to the invention, and means to connect the fourth chamber having an annular cross section of one of said jacks (located on the rod side of the annular piston) with the third chamber having an annular cross section of the other jack.

BRIEF DESCRIPTION OF THE DRAWINGS

The invention and its advantages will become more apparent from the descriptions of the embodiments presented hereinafter, with reference to the drawings, in which.

DETAILED DESCRIPTION OF THE PREFERRED EMBODIMENTS

The arrows on the lines indicate the direction of the circulation of the liquid effecting the extension of the jack or jacks shown.

Figure 1:
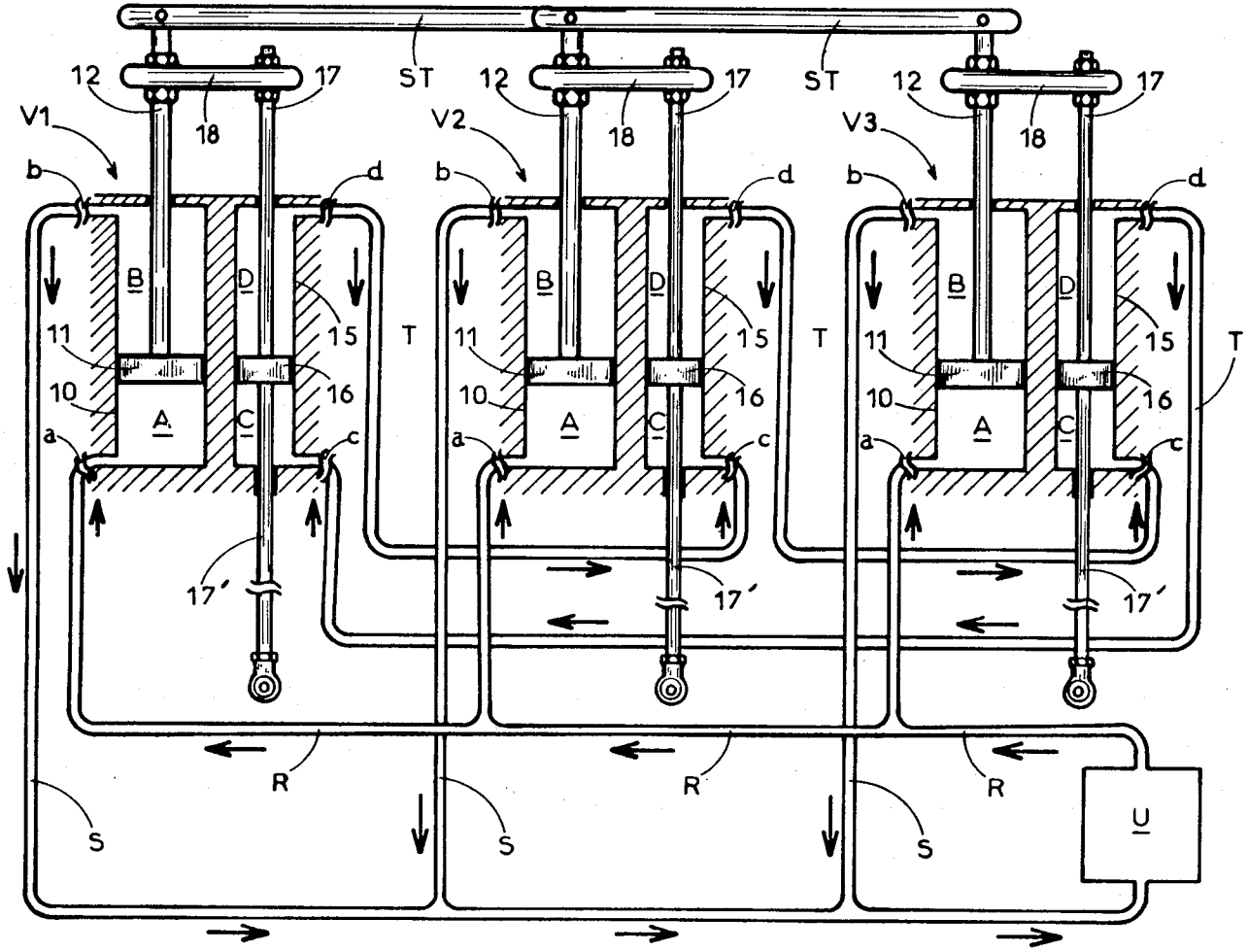
FIG. 1 (PRIOR ART)
FIG. 1 is a schematic diagram of the general layout of a system of synchronized, double cylinder jacks, according to the prior art.

FIG. 1 shows a prior art mechanism utilizing a plurality of two-cylinder jacks. In the example considered, three identical jacks V1, V2 and V3 are shown, although more or less could be used. Each of them comprises: a cylinder 10 and a piston 11 connected by rod 12 to the structure ST to be moved. Piston 11 divides the volume of cylinder 10 into two chambers, i.e., a second chamber B located on the side of piston 11 connected to rod 12 and communicating with hydraulic line connection b, and a first chamber A located on the face side of piston 11 and communicating with hydraulic line connection a; a cylinder 15 and a piston 16 connected by rod 17 via crosspiece 18 to rod 12. Piston 16 divides the volume of cylinder 15 into two chambers, i.e., a fourth chamber D located on the side of piston 16 connected with said crosspiece and communicating with a hydraulic line connection d, and a third chamber C located on the opposite side of piston 16 and communicating with a hydraulic line connection c. The side of cylinder 15 opposite to the outlet of the rod 17 is traversed by a counter rod 17' of the same diameter.

The cylinder 10 and the cylinder 15 of each jack are connected rigidly with each other and a common frame indicated by shading. All of the hydraulic line connections a are connected in parallel by the lines R and with one of the conveying orifices of an hydraulic control unit U. All of the hydraulic line connections b are connected in parallel by means of the lines S and with the other conveying orifice of control unit U. The jacks V1, V2 and V3 thus operate as double action jacks. According to the direction of the arrows on the various hydraulic lines, it is seen that lines R deliver the liquid into the chambers A, while the pistons 11 force the liquid fom the chambers B into the lines S.

The hydraulic line connection d of each jack is connected through a line T with the hydraulic line connection c of an adjacent jack, the index of which follows in keeping with the rules of circular permutation.

For example, in the case of the three jacks considered: the hydraulic line connection d of V1 is connected to the hydraulic line connection c of V2; the hydraulic line connection d of V2 is connected to the hydraulic line connection c of V3; and, the hydraulic line connection d of V3 is connected to the hydraulic line connection c of V1.

By reason of the incompressibility of the liquid in chambers C and D, it follows that the pistons 16 mutually cause each other to occupy the same position in their cylinders 15 and that each of them imposes this position on the corresponding piston 11 in its cylinder 10. The cylinders 10 may be designated the "working cylinders", because each of them effects, by means of the piston 11, a differential thrust, positive or negative, resulting from the pressures admitted respectively into the chambers A and B. The cylinders 15 may be designated "master cylinders" as the differential thrust applied by each of them to the rod 12 of the corresponding cylinder 10 constitutes a thrust correction force which is added algebraically to the thrust exerted by the piston 11 to obtain an identical elongation of all the jacks. All of the points of the structure ST connected to the rods 12 thus undergo an identical translation.

Even though the operating principle of the embodiment of FIG. 1 is irreproachable, it has appreciable disadvantages, notably: the excessive lateral and longitudinal dimensions of each double jack; the complexity of application and installation; and, the lack of rigidity of the connections between the two piston rods of the same jack.

Figure 2:
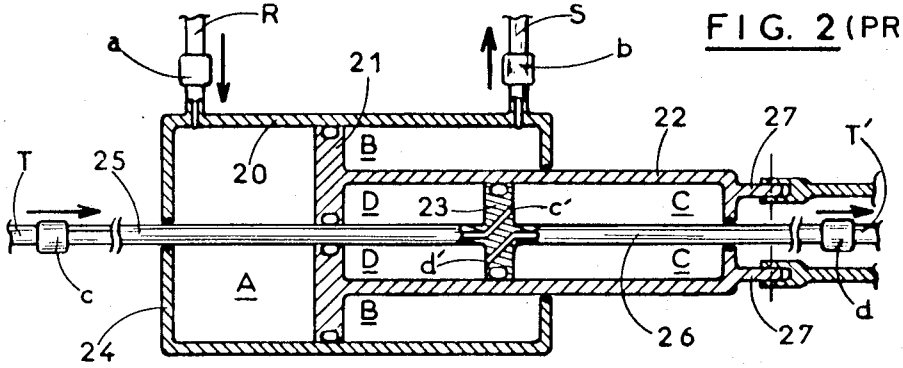
FIG. 2 (PRIOR ART)
FIG. 2 is a longitudinal cross-sectional view of a two-cylinder coaxial jack of a known type.

A known improvement over this type of double jack, illustrated in FIG. 2 does not have these disadvantages, due to the fact that the cylinders are coaxial. The chambers and hydraulic line connections which perform the same functions as in the double jacks of FIG. 1 are designated by the same letters.

The "working cylinder" 20 has hydraulic line connections a (communicating with the chamber A) and b (communicating with the chamber B) and houses piston 21. The latter is connected to a hollow rod 22 which emerges from one end of the cylinder 20 through a liquid-tight passage, and which performs the roles both of a rod transmitting the force of the jack and of the "master cylinder". Piston 23, slidably retained in hollow rod 22 is supported on an end 24 of cylinder 20 opposite the hollow rod 22, by a hollow shaft 25 carrying the hydraulic line connection c and being connected in a liquid-tight fashion with said end 24 and, on the same side as the hollow rod 22, by a hollow shaft 26 which carries the hydraulic line connection d and which passes through the end of hollow rod 22 through a liquid-tight passage.

The "master cylinder" consists of hollow rod 22 which is mobile with respect to the "working cylinder" 20, while the piston 23, housed in said master cylinder, is mobile with respect to the latter but stationary with respect to the "working cylinder" 20.

The piston 23 is traversed by the orifices c' and d', through which, respectively, the hollow shaft 25 connects the hydraulic line connection c with the chamber C (the portion of the hollow rod 22 which surrounds the hollow shaft 26), while the hollow shaft 26 connects the hydraulic line connection d with the chamber D (the portion of the hollow rod 22 surrounding the hollow shaft 25). Consequently, as in the examples of the double jacks of FIG. 1, the differential thrust applied to the piston 21 by the pressures prevailing in the chamber A, connected to a line R by the hydraulic line connection a and in the chamber B, connected to the line S by the hydraulic line connection b, is corrected by the differential thrust due to the pressures prevailing respectively in the chambers C and D, one of which is connected to a line T and the other to a further line T'.

An examination of FIG. 2 shows that this form of the double jacks of the prior art has the following disadvantages, which may be highly inconvenient: an appreciably greater longitudinal dimension on the side of the control rod than that of the double jacks of FIG. 1 by reason the presence of the hollow shaft 26; and, difficult attachment of the rod 22 to the structure to be moved (not shown), because in order to center the thrust force on the longitudinal axis of the jack, it is necessary to provide multiple points of attachment (represented by the lugs 27), symmetrically with respect to the shaft 26 and to connect these points of attachment with the structure by connections the length of which exceeds that of the shaft 26.

Figure 3:
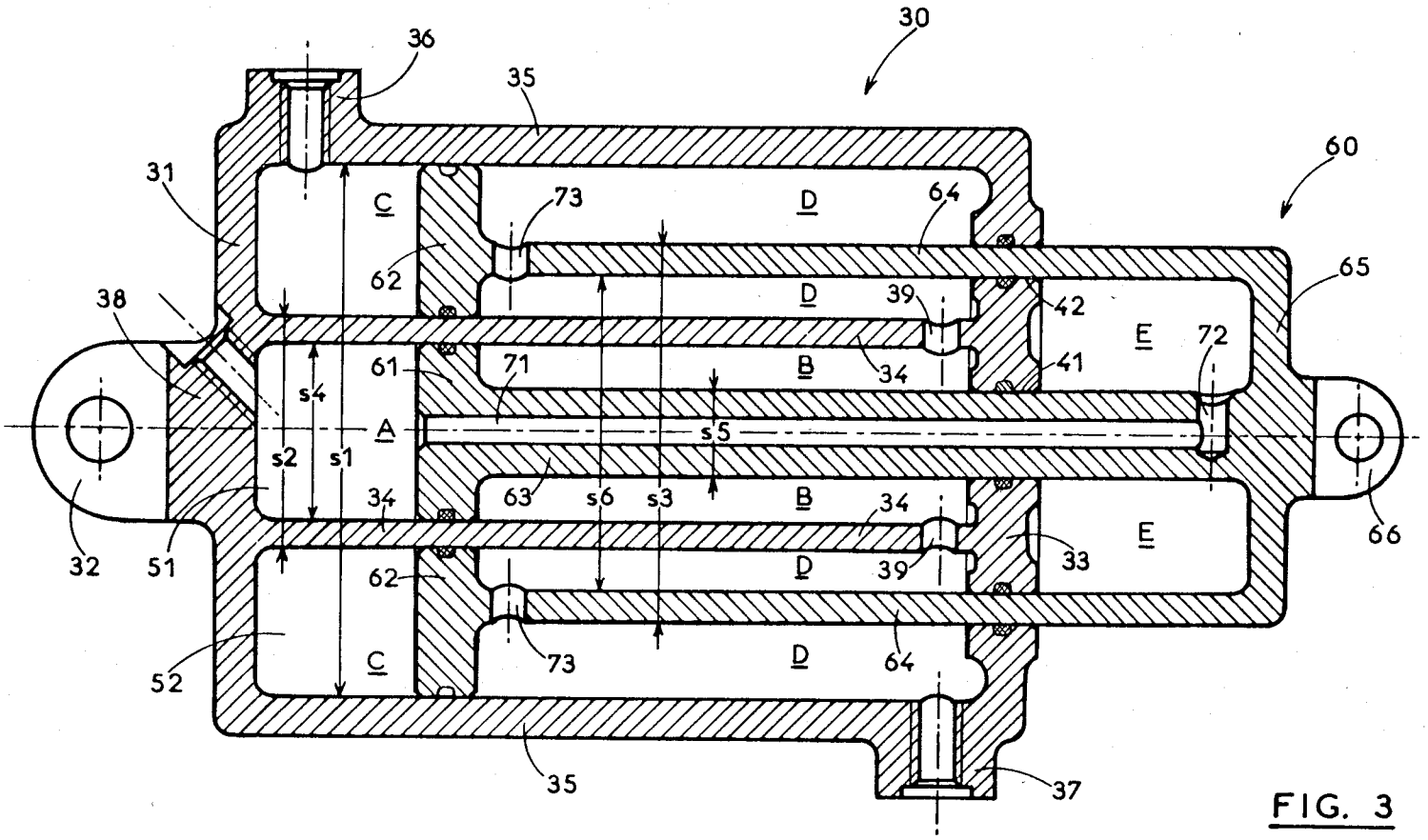
FIG. 3 is a longitudinal cross-sectional view of a multiple chamber, coaxial, two-cylinder jack according to the invention.

Let us consider now FIG. 3 which shows in detail the configuration of a double cylinder jack according to the invention, in which the disadvantages have been eliminated.

The elements of the structure to which the jack is to impart a relative movement are not shown. The end 31 of the double cylinder 30 is, for example, attached to one of these elements by means of the lug 32. The external rod 64 of the double piston 60 (see hereinbelow), which emerges from the other end 33 on the side of the head of the cylinder is, for example, fastened to the other element by a lug 66.

An annular median wall 34 extends along the length of cylindrical body 30 and divides its interior into a center cavity 51 and a peripheral cavity 52, which is bounded on the outside by the outer wall 35. The latter carries near the end 31 a connecting boss 36 and near the end 33 a connecting boss 37. This two bored bosses make it possible to connect the cavity 52 to hydraulic tubes, not shown. The end 31 also carries a bored boss 38 which permits the connection of the cavity 51 with a third hydraulic tube, not shown.

The annular intermediate wall 34, near the first end 33, defines orifices 39 which establish communication between the two cavities 51 and 52. The double piston 60, comprises center piston 61 which slides in the center cavity 51 and is attached to central rod 63 which, in turn, emerges from the first end 33 through a center orifice 41, and, annular piston 62 which slides in the annular cavity 52 and which is attached to annular rod portion 64, which emerges from the end 33 through an annular orifice 42.

Outside the cylinder, the distal ends of rod portions 63 and 64 are interconnected by end 65 which closes the cavity defined by annular rod portion 64 to form a fluid tight fifth chamber E, and which carries the lug 66.

The circumference of the center piston 61, the internal and external peripheries of the annular piston 62, the periphery of the orifice 41 and the outer and inner peripheries of the orifice 42 carry toroidal gaskets to prevent leakage of hydraulic fluid.

An axial channel 71 extends through the center piston 61, the center rod 63 and communicates with at least one orifice 72, opening into the periphery of the rod 63 near the end 65 to allow fluid communication between first chamber A and fifth chamber E. Orifices 73 pass through the peripheral rod 64 near the piston 62 to equalize fluid pressures on both sides of annular rod portion 64.

The double piston 60 thus cooperates with the cylinder 30 to define five chambers, notably: first chamber A bounded by the end 31, the center piston 61 and the intermediate annular wall 34; second chamber B bounded by the center piston 61, the center rod 63, the intermediate wall 34 and the end 33; third chamber C bounded by the end 31, the annular piston 62, the intermediate wall 34 and the external wall 35; fourth chamber D bounded by the annular piston 62, the end 33 and the walls 34 and 35 (the orifices 73 balance the pressures on either side of the mobile wall constituted by the rod 64); and, fifth chamber E bounded by the end 33 of the cylinder, the rods 63 and 64, and the end 65 of the rod.

The chambers A and E, which communicate through the channel 71 and the orifice 72, are thus both in communication with an hydraulic line connected with the bore of the center boss 38. The chambers B and D, which communicate through the orifices 39, are both in communication with an hydraulic line connected with the bore of the boss 37. Only the chamber C is in communication with an hydraulic line connected with the bore of the boss 36.

FIG. 3 shows in the form of diametrical indexing lines, the following transverse sections:

s1: internal section bounded by the outer wall 35;

s2: external section occupied by the intermediate wall 34;

s3: external section occupied by the annular rod 64;

s4: internal section bounded by the intermediate wall 34;

s5: external section of the center rod 63; and, s6: internal section bounded by the annular rod 64.

The values of these sections shall be used hereinafter to determine the conditions of assuring the correct synchronization of the movements of several jacks according to the invention in a system of synchronized jacks.

Figure 4:
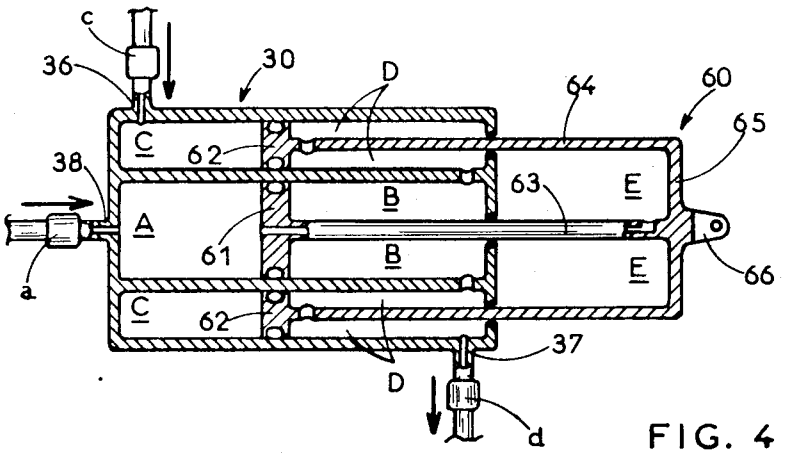
FIG. 4 is a longitudinal cross-sectional schematic diagram of the jack shown in FIG. 3.

Let us consider now FIG. 4 which shows the jack of FIG. 3 according to the invention, in a schematic form similar to that used in FIGS. 1 and 2 relative to the double cylinder jacks of the prior art. Pistons 61 and 62 separate, the first and second chambers A and B, and the third and fourth chambers C and D. There is also present an additional piston consisting of the end 65, which connects the center rod 63 and the annular rod 64. The hydraulic connections a, c and d provide, respectively, connections of the piping system to the chamber A (boss 38 of FIG. 3), the chamber C (boss 36) and the chamber D (boss 37).

It should be noted that in the embodiment that is shown and preferred, the two pistons 61 and 62 are located in the same transverse plane to avoid the presence of residual volumes of hydraulic fluid at the end of the stroke.

Although intended to constitute with other, identical jacks a system of synchronized jacks, the jack according to the invention may be used as a single jack. For use as a single jack with single action, it is sufficient to connect the hydraulic line connections a and c to the same source of pressure and to vent the line connection d to the atmosphere (if the chambers B and D are empty) or connect it to a tank (if the chambers B and D contain liquid). Pressure in the chambers A, C and E causes the jack to extend and the cancellation of this pressure causes its retraction under the effect of force in the opposite direction applied to the lug 66.

To use the jack of the invention as an individual double action jack, it is possible to obtain an extension, by communicating a source of pressure with the chambers A and E (via line connection a) or the chambers A, C and E (via line connections a and c). The retraction is obtained by the communication of the source of pressure with the chambers B and D (via line connection d).

Figure 5:
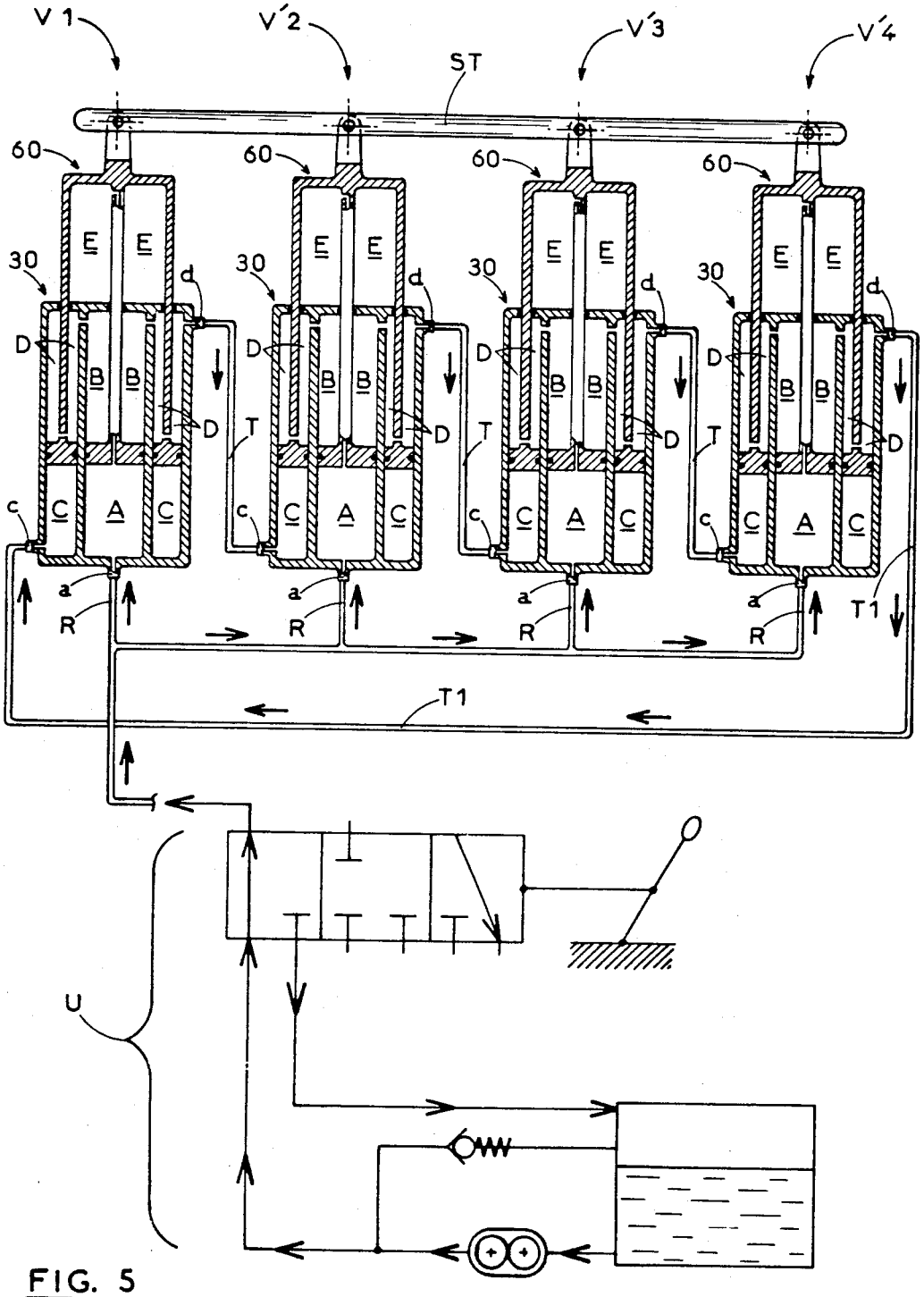
FIG. 5 is a schematic diagram of an hydraulic system utilizing single action jacks according to the invention.
Figure 6:
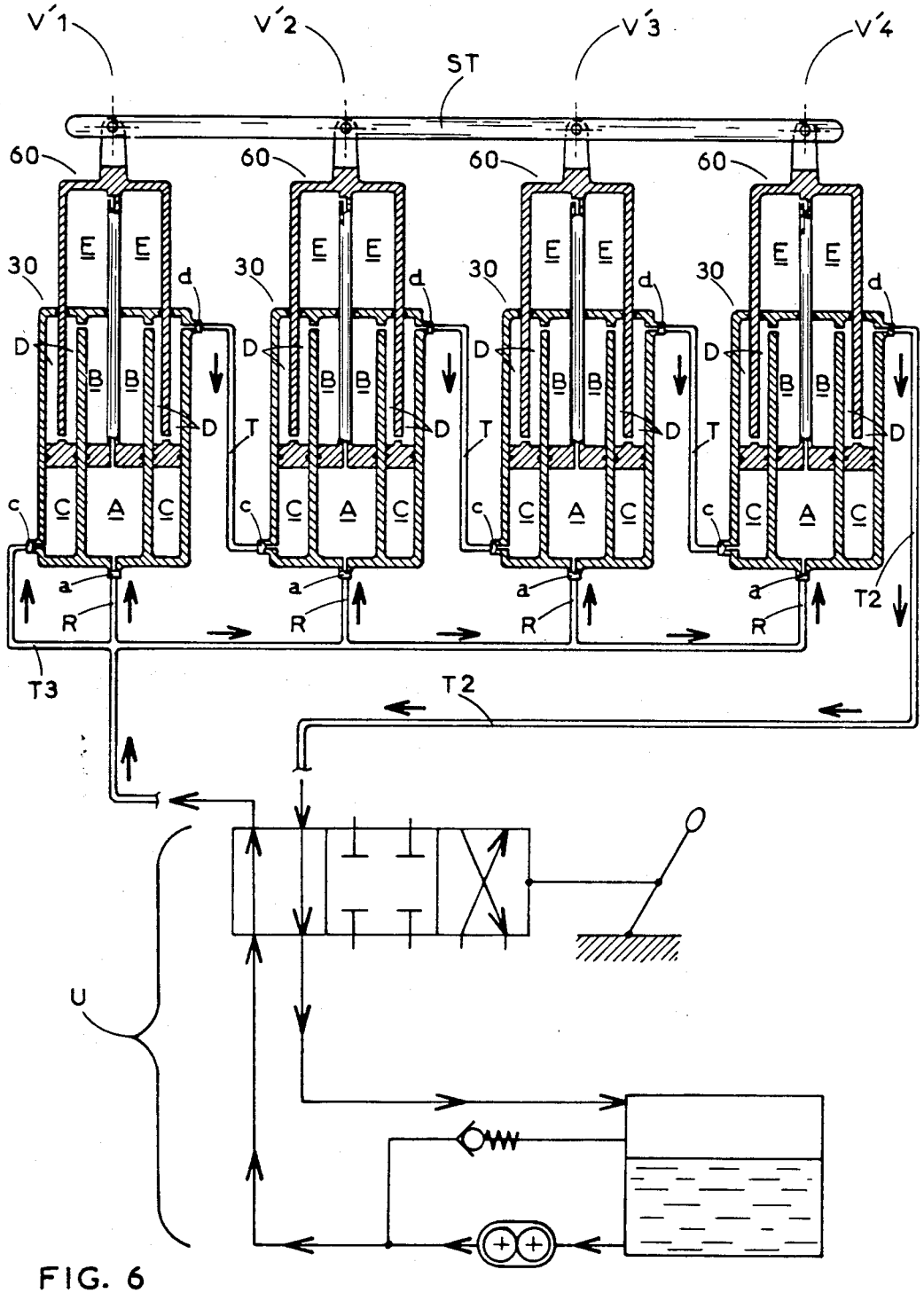
FIG. 6 is a schematic diagram of an hydraulic system utilizing double action jacks according to the invention.

Let us consider now FIGS. 5 and 6 relative to a system of synchronized jacks using a number N of jacks according to the invention. Four jacks are seen in the Figures, identified respectively as V'1, V'2, V'3 and V'4. FIG. 5 illustrates the case wherein these jacks are used as single action jacks and FIG. 6 shows the case where they are used as double action jacks. The pressure source includes a distributor valve making it possible to switch the connecting lines either to a reservoir under pressure or to a tank to constitute in this manner a control unit U.

In these two cases of usage, the extension of the jacks is obtained by the injection of liquid under pressure into the chambers A and E (via hydraulic line connection a) supplied in parallel by the lines R.

For use as single action jack, the line connection d of each jack is connected with the line connection c of the jack which follows it in the order of indices and reference numbers, by using the rules of circular permutation. More precisely, if the line connections c and d of a jack V'(J) are designated c(J) and d(J), with J assuming discrete values from 1 to N, any line connection d(J) is connected by means of a line T with the line connection c(J+1), with the exception of the line connection d(N) (here the line connection d of the jack V'4) which is connected with the line connection c(1) (here the line connection c of the jack V'1) by means of the line T1. The jacks are thus interconnected in a closed loop and control each other mutually.

For use as double action jacks, as shown in FIG. 6, the lines T remain and a line T2 connects the line connection d(N) with the control unit U to allow the circulation of the liquid from the pump. The line connection c(1) is supplied by means of a line T3 connected in parallel with the line connection a(1). The retraction of the jacks is obtained by reversing the direction of circulation of the hydraulic liquid by moving the distributor valve of the control unit U.

In these two cases, to obtain synchronous strokes of the rods 60 connected with the structure ST, the active cross-section of the chamber C must be equal to the sum of the active cross-sections of the chambers B and D. In other words, on referring to FIG. 3, it is seen that the indices of the elements used must be:

$$s1-s2=s1-s3+s6-s2+s4-s5$$

i.e., $$s4-s5=s3-s6$$

This condition is easily realized by assigning adequate values to the inner diameter of the intermediate annular wall 34, the diameter of the center rod 63, and the external and internal diameters of the annular rod 64.

The advantages of a jack according to the invention over the prior art is obvious by comparison of FIGS. 1 or 2 with FIGS. 5 or 6. The jack of the invention requires only three hydraulic line connections and the synchronized systems of jacks they permit to be constructed use a reduced number of connecting liens and are simpler to install than the systems using jacks of the prior art.

It is sufficient to compare the diagrams of FIGS. 2 and 4 to find that, with respect to the jack of the aforecited French patent, the jack according to the instant invention effectively has the following advantages as the result of the elimination of the hollow shafts 25 and 26: reduced longitudinal dimension; shortening of the connections between the rod and the structure to be moved; and, elimination of fragile and low rigidity elements.

Figure 7:
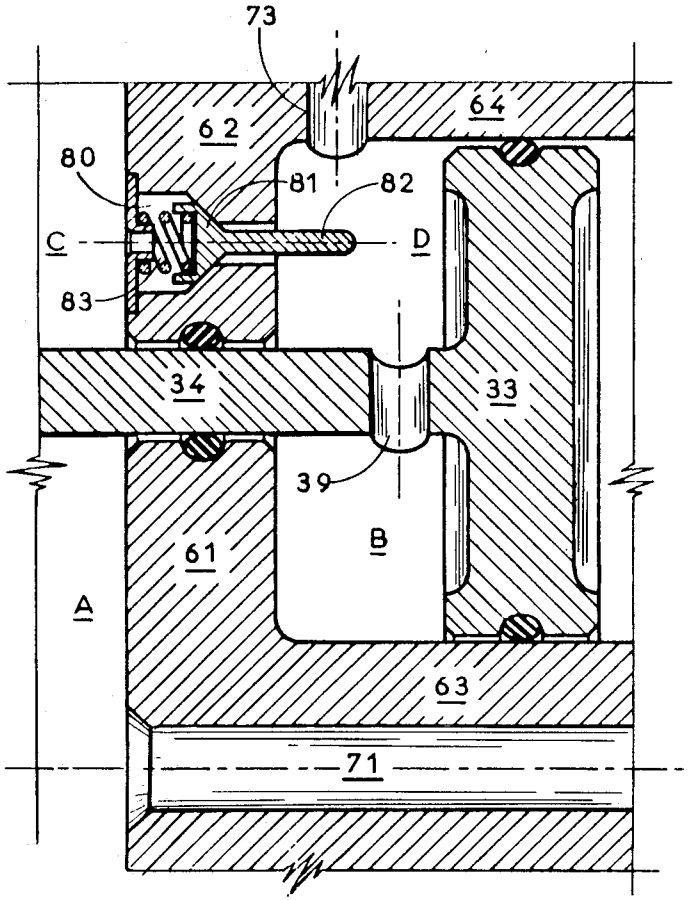
FIG. 7 is a partial longitudinal sectional view of the annular piston of a jack according to the invention, illustrating a stroke limiting safety device.

In such complex jacks, slight defects of synchronization in the system of jacks may cause small leaks at the locations of the joints. Naturally, it is possible to compensate for these leaks by the means shown in FIG. 7. The piston 62 of each jack contains a device which automatically balances the pressures prevailing on both sides of the piston at the end of its stroke. This device may consist of a poppet valve 81 housed in an orifice 80 provided in the piston. The valve is held against its seat by a spring 83 and carries a pushrod 82 directed toward the end wall 33. If the jack is to be operated in a double action mode, it is possible to locate, in the same piston, a second identical valve, but with its pushrod oriented toward the end wall 31 (FIG. 3).

Near the end of its stroke, pushrod 82 contacts end wall 33 and, as the piston continues to the end of its stroke, valve 81 is displaced from its seat to equalize the pressures on both sides of the piston.

While the present invention has now been described in terms of certain embodiments, one skilled in the art will readily appreciate that various modifications, changes, omissions and substitutions may be made without departing from the spirit thereof. It is intended, therefore, the the present invention be limited solely by the scope of the following claims.

I claim:

1. A multiple chamber, coaxial hydraulic jack comprising:

(a) a hollow cylindrical body defining an interior, the body having an annular median wall extending along the length of the interior to divide the interior into a cylindrical center cavity and an annular peripheral cavity, the annular median wall defining an orifice near a first end of the cylindrical body to permit communication between the respective cavities;

(b) a center piston defining an opening therethrough slidably retained within the center cavity and dividing the center cavity into first and second chambers;

(c) an annular piston slidably retained within the annular peripheral cavity and dividing the annular peripheral cavity into third and fourth chambers, the second and fourth chambers being located on the same sides of the center and annular pistons such that the orifice through the annular median wall allows communication therebetween, the area of the side of the annular piston facing the third chamber being equal to the sum of the effective areas of the sides of the annular piston and the central piston facing the fourth and second chambers, respectively;

(d) an annular piston rod portion attached to the annular piston, and extending through the fourth chamber and the first end of the cylindrical body;

(e) a central piston rod portion attached to the central piston, and extending through the second chamber and the first end of the cylindrical body, the distal ends of the annular piston rod portion and the central piston rod portion being joined by a rod end wall so as to form a fifth chamber between the rod end wall and the first end of the cylindrical body, the central piston rod portion defining an axial channel to allow fluid communication between the first and fifth chambers;

(f) at least one orifice defined by the annular rod portion adjacent the annular piston; and, (g) means to introduce hydraulic fluid into the first, third and fourth chambers.

2. The multiple chamber, coaxial hydraulic jack of claim 1 wherein the central piston and the annular piston are located in the same plane.

3. A system for the synchronized movement of a plurality of hydraulic jacks comprising:

(a) a plurality of hydraulic jacks, each jack comprising:

(i) a hollow cylindrical body defining an interior, the body having an annular median wall extending along the length of the interior to divide the interior into a cylindrical center cavity and an annular peripheral cavity, the annular median wall defining an orifice near a first end of the cylindrical body to permit communication between the respective cavities;

(ii) a center piston defining an opening therethrough slidably retained within the center cavity and dividing the center cavity into first and second chambers;

(iii) an annular piston slidably retained within the annular peripheral cavity and dividing the annular peripheral cavity into third and fourth chambers, the second and fourth chambers being located on the same sides of the center and annular pistons such that the orifice through the annular median wall allows communication therebetween, the area of the side of the annular piston facing the third chamber being equal to the sum of the effective areas of the sides of the annular piston and the central piston facing the fourth and second chambers, respectively;

(iv) an annular piston rod portion attached to the annular piston, and extending through the fourth chamber and the first end of the cylindrical body;

(v) a central piston rod portion attached to the central piston, and extending through the second chamber and the first end of the cylindrical body, the distal ends of the annular piston rod portion and the central piston rod portion being joined by a rod end wall so as to form a fifth chamber between the rod end wall and the first end of the cylindrical body, the central piston rod portion defining an axial channel to allow fluid communication between the first and fifth chambers; and (vi) at least one orifice defined by the annular rod portion adjacent the annular piston;

(b) a source of pressurized hydraulic fluid;

(c) first conduit means to supply pressurized hydraulic fluid to the first chambers of each jack; and (d) second conduit means connecting the fourth chamber of one jack with the third chamber of the adjacent jack.

4. A system for the synchronized movement of a plurality of hydraulic jacks comprising:

(a) a plurality of hydraulic jacks, each jack comprising:

(i) a hollow cylindrical body defining an interior, the body having an annular median wall extending along the length of the interior to divide the interior into a cylindrical center cavity and an annular peripheral cavity, the annular median wall defining an orifice near a first end of the cylindrical body to permit communication between the respective cavities;

(ii) a center piston slidably retained within the center cavity and dividing the center cavity into first and second chambers;

(iii) an annular piston slidably retained within the annular peripheral cavity and dividing the annular peripheral cavity into third and fourth chambers, the second and fourth chambers being located on the same sides of the center and annular pistons such that the orifice through the annular median wall allows communication therebetween, the area of the side of the annular piston facing the third chamber being equal to the sum of the effective areas of the sides of the annular piston and the central piston facing the fourth and second chambers, respectively;

(iv) an annular piston rod portion attached to the annular piston, and extending through the fourth chamber and the first end of the cylindrical body;

(v) a central piston rod portion attached to the central piston, and extending through the second chamber and the first end of the cylindrical body, the distal ends of the annular rod portion and the central rod portion being joined by a rod end wall so as to form a fifth chamber between the rod end wall and the first end of the cylindrical body, the central rod portion defining an axial channel to allow fluid communication between the first and fifth chambers; and, (vi) at least one orifice defined by the annular rod portion adjacent the annular piston;

(b) a source of pressurized hydraulic fluid;

(c) first conduit means to supply pressurized hydraulic fluid to the first chambers of each jack; and, (d) second conduit means connecting the fourth chamber of one jack with the third chamber of the adjacent jack;

(e) third conduit means to supply pressurized hydraulic fluid to the third chamber of a first hydraulic jack; and (f) fourth conduit means connecting the fourth chamber of a last hydraulic jack to a hydraulic fluid tank.

* * * * *

UNITED STATES PATENT AND TRADEMARK OFFICE

CERTIFICATE OF CORRECTION

PATENT NO. : 4,531,451

DATED : July 30, 1985

INVENTOR(S) : Pierre C. Mouton

It is certified that error appears in the above-identified patent and that said Letters Patent is hereby corrected as shown below:

Col. 3, line 39: "fom" should read -- from --.

Col. 4, line 56: after "reason" insert -- of --.

Col. 5, line 14: "This" should read -- These --.

Col. 6, line 65: after "use as" insert -- a --.

Col. 7, line 41: "liens" should read -- lines --.

Col. 10, line 39: delete "and".

Signed and Sealed this

*Twenty-second* Day of *April 1986*

[SEAL]

*Attest:*

DONALD J. QUIGG

*Attesting Officer*

*Commissioner of Patents and Trademarks*